US012479061B1

(12) United States Patent
Haldar et al.

(10) Patent No.: US 12,479,061 B1
(45) Date of Patent: Nov. 25, 2025

(54) MAGNETORHEOLOGICAL ABRASIVE FLOW NANO-FINISHING (RR-MRAFNF) MACHINE

(71) Applicant: IMAM MOHAMMAD IBN SAUD ISLAMIC UNIVERSITY, Riyadh (SA)

(72) Inventors: Barun Haldar, Riyadh (SA); Atul Singh Rajput, Mangaluru (IN); Arpan Kumar Mondal, Kolkata (IN); Naser A. Alsaleh, Riyadh (SA); Nashmi H. Alrasheedi, Riyadh (SA)

(73) Assignee: IMAM MOHAMMAD IBN SAUD ISLAMIC UNIVERSITY, Riyadh (SA)

( * ) Notice: Subject to any disclaimer, the term of this patent is extended or adjusted under 35 U.S.C. 154(b) by 0 days.

(21) Appl. No.: 19/062,183

(22) Filed: Feb. 25, 2025

(51) Int. Cl.
*B24B 31/112* (2006.01)
*B24B 1/00* (2006.01)

(52) U.S. Cl.
CPC ..... *B24B 31/112* (2013.01); *B24B 1/005* (2013.01)

(58) Field of Classification Search
CPC ... B24B 31/003; B24B 31/102; B24B 31/112; B24B 31/116; B24B 1/005; B24C 1/005; B24C 5/08; B24C 7/0007
(Continued)

(56) References Cited

U.S. PATENT DOCUMENTS 2,883,809 A * 4/1959 Simjian ..... B24B 31/003 451/36
3,848,363 A * 11/1974 Lovness ..... B24B 31/102 451/36

(Continued)

FOREIGN PATENT DOCUMENTS

CN 116985025 A * 11/2023
IN 386779 B 1/2022
IN 434551 B 6/2023

OTHER PUBLICATIONS

Wen, CN-116985025-A machine translation, Nov. 3, 2023 (Year: 2023).*

(Continued)

*Primary Examiner* — Brian D Keller
*Assistant Examiner* — Marcel T Dion
(74) *Attorney, Agent, or Firm* — Oblon, McClelland, Maier & Neustadt, L.L.P.

(57) ABSTRACT

An apparatus and a polishing system for rotational magnetorheological abrasive flow nano-finishing are described. The apparatus includes an upper cylinder with coupled upper piston and a lower cylinder with coupled lower piston. A first motor drives synchronized reciprocating motion of both pistons via respective slider crank mechanisms. A magnet fixture positioned between the cylinders includes permanent magnets arranged in a ring configuration with a central hole for workpiece placement. A second motor rotates the magnet fixture to manipulate magnetic field (Continued)

orientation. The cylinders, pistons and magnet fixture define a space for containing magnetorheological (MR) fluid including ferromagnetic particles, abrasive particles and carrier fluid. The configuration enables controlled fluid flow through the hole while maintaining direct workpiece contact, with ferromagnetic particles exhibiting both rotational and reciprocal movement patterns. This dual-motion finishing approach enables material removal through magnetic field-controlled abrasive action, achieving nano-scale surface quality on complex geometries.

16 Claims, 9 Drawing Sheets

(58) Field of Classification Search
USPC ..... 451/36, 91, 93, 94
See application file for complete search history.

(56) References Cited

U.S. PATENT DOCUMENTS 4,040,209 A * 8/1977 Shikhirev ..... B24B 1/005 451/190
6,475,071 B1 * 11/2002 Joslyn ..... B01D 33/11 451/36
9,463,548 B2 * 10/2016 Versluys ..... B24B 31/064
2004/0266320 A1 * 12/2004 Walch ..... B24B 31/116 451/36
2019/0091826 A1 * 3/2019 Adriany ..... B24C 7/0015
2022/0258298 A1 * 8/2022 Wosniak ..... B24B 31/116
2022/0388110 A1 * 12/2022 Tropschuh ..... B24B 31/003

OTHER PUBLICATIONS

S. Karthikeyan, et al., "Effect of process parameters on machinability, hemocompatibility and surface integrity of SS 316L using R-MRAFF", Journal of Materials Research and Technology, vol. 15, Sep. 24, 2021, pp. 2658-2672.

Manas DAS, et al., "The Out-of-Roundness of the Internal Surfaces of Stainless Steel Tubes Finished by the Rotational-Magnetorheological Abrasive Flow Finishing Process", Materials and Manufacturing Processes, vol. 26, No. 8, Aug. 3, 2011, pp. 1073-1084. 13 pages.

* cited by examiner

MAGNETORHEOLOGICAL ABRASIVE FLOW NANO-FINISHING (RR-MRAFNF) MACHINE

BACKGROUND

Technical Field

The present disclosure is directed generally to the field of advanced manufacturing technology, and more particularly to precision surface finishing apparatus and methods. Specifically, the present disclosure relates to magnetorheological abrasive flow finishing systems that utilize controlled magnetic fields and rotational dynamics for achieving nano-scale surface finishing of complex geometries.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Surface finishing technology plays an important role in manufacturing process, that directly influences component performance, reliability, and longevity across high-precision industries. The evolution of surface finishing methods has been driven by increasingly stringent requirements for surface quality, particularly in applications such as aerospace components, medical implants, precision tooling, and advanced instrumentation. Traditional surface finishing approaches encompass a range of mechanical processes including grinding, lapping, honing, and polishing, each utilizing specifically designed abrasive media to achieve controlled material removal. These conventional methods typically employ fixed abrasive tools, where abrasive particles are bonded to a substrate, or loose abrasive processes, where particles are suspended in a carrier medium.

For instance, Abrasive Flow Finishing (AFF) processes involve forcing a viscoelastic medium containing abrasive particles through workpiece passages to achieve surface modification. This approach has been widely implemented for finishing internal surfaces and complex geometries that are difficult to access using conventional polishing methods. The process typically utilizes pressure-driven flow of abrasive media to generate material removal through controlled contact between abrasive particles and workpiece surfaces. However, conventional AFF processes exhibit significant limitations in achieving precise control over the material removal rate and uniformity of surface finish. A primary challenge lies in the inconsistent distribution of abrasive particles within the finishing medium, leading to non-uniform material removal rates and variable surface quality across different regions of the workpiece. Additionally, these processes often require extended processing times to achieve desired surface finish levels, particularly when working with hard materials or complex geometrical features.

Magnetorheological Finishing (MRF) technology has emerged as an alternative approach, utilizing magnetic fields to control the rheological properties of the finishing medium. While MRF processes offer improved control over the finishing action, they are predominantly limited to external surface applications and lack the capability to effectively process internal geometries and complex passages.

These conventional approaches face significant challenges in achieving precise control over material removal rates while maintaining process stability and surface finish uniformity, particularly when processing complex internal geometries and hard-to-reach surfaces. The limitations become especially pronounced when working with advanced materials requiring nano-scale surface finish quality.

IN386779B describes a rotational magnetorheological abrasive flow finishing device incorporating a cylindrical magnetic fixture with multiple slots for permanent magnets and a workpiece fixture. The system utilizes hydraulic cylinders for reciprocating motion of the magnetorheological (MR) fluid and a motor-driven belt system for fixture rotation.

IN434551B describes a magnetorheological finishing machine featuring a vertically oriented finishing tool with a central rotating core and stationary electromagnet coils. The system employs a servo motor and belt drive arrangement for rotational motion control.

Das et al., in their work on internal surface finishing of stainless-steel tubes, describe a rotational magnetorheological abrasive flow finishing process utilizing opposing pistons driven by a hydraulic unit combined with rotating permanent magnets.

Karthikeyan et al. present a rotational magnetorheological abrasive flow finishing machine incorporating hydraulic cylinders and a rotating die connected to an electric motor via a flat belt drive.

Each of the aforementioned references suffers from one or more drawbacks hindering their adoption, such as limited control over material removal rates, inconsistent surface quality across complex geometries, insufficient process stability during extended operations, and reduced finishing efficiency when processing advanced materials. For example, none of the aforementioned references provide synchronized piston operation through a single motor drive system coupled with coordinated magnetic field control for processing complex internal geometries. Additionally, existing systems often lack synchronization between fluid dynamics and magnetic field control, leading to undesirable surface finishing outcomes. The absence of integrated motion control and coordinated actuation mechanisms further limits the resultant surface quality and process reliability. Accordingly, it is one object of the present disclosure to provide an apparatus and a polishing system that offer enhanced control over the finishing process through synchronized mechanical and magnetic actuation while maintaining operational stability and process efficiency.

SUMMARY

In an exemplary embodiment, an apparatus includes an upper cylinder; an upper piston coupled with the upper cylinder; a lower cylinder; a lower piston coupled with the lower cylinder; a first motor configured to slide the upper piston along an inner surface of the upper cylinder via an upper slider crank mechanism and slide the lower piston along an inner surface of the lower cylinder via a lower slider crank mechanism; a magnet fixture positioned between the upper cylinder and the lower cylinder, including at least one permanent magnet, and having a shape of a ring and a hole in the ring configured to receive a workpiece therein; and a second motor configured to rotate the magnet fixture so as to rotate the at least one permanent magnet, wherein the upper piston, the upper cylinder, the magnet fixture, the lower piston and the lower cylinder define a space that is configured to receive a magnetorheological (MR) fluid including ferromagnetic particles, abrasive particles and a carrier fluid, and the upper piston, the upper cylinder, the magnet fixture, the lower piston and the lower cylinder are arranged such that as the MR fluid flows through the hole while being in direct contact with the workpiece within the hole, the ferromagnetic particles in the MR fluid move rotationally and reciprocally.

In some embodiments, the magnet fixture includes slots distributed along a circumference of the hole and permanent magnets positioned in the slots.

In some embodiments, the hole is circular. The slots are rectangular. The permanent magnets are rectangular. Each permanent magnet is positioned in a respective slot and has a respective magnetic pole facing the circumference of the hole and another respective magnetic pole facing away from the circumference of the hole.

In some embodiments, the magnet fixture includes pin structures positioned at end positions of the slots, and the permanent magnets extend into a circular circumference of the hole.

In some embodiments, the upper slider crank mechanism includes an upper crank and an upper connecting rod coupled with the upper crank and connected to the upper piston, and the lower slider crank mechanism includes a lower crank and a lower connecting rod coupled with the lower crank and connected to the lower piston.

In some embodiments, the apparatus further includes a middle pulley configured to be rotated by the first motor; an upper V-belt coupled with the middle pulley; an upper shaft coupled with the upper V-belt and the upper crank and configured to be rotated by the middle pulley via the upper V-belt so as to rotate the upper crank; a lower V-belt coupled with the middle pulley; and a lower shaft coupled with the lower V-belt and the lower crank and configured to be rotated by the middle pulley via the lower V-belt so as to rotate the lower crank.

In some embodiments, the upper V-belt and the lower V-belt are staggered along the middle pulley so that the first motor is configured to rotate the upper shaft and the lower shaft synchronously and slide the upper piston and the lower piston synchronously.

In some embodiments, the middle pulley includes a middle wheel and a middle shaft connecting the middle wheel to the first motor, and the middle wheel is oriented to have an upper rotating surface and a lower rotating surface and have two opposite sides along a longitudinal direction of the middle shaft.

In some embodiments, the upper V-belt is in direct contact with the lower rotating surface of the middle wheel and positioned on one of the two opposite sides of the middle wheel, and the lower V-belt is in direct contact with the upper rotating surface of the middle wheel and positioned on another one of the two opposite sides of the middle wheel.

In some embodiments, the apparatus further includes an upper wheel via which the upper V-belt is configured to rotate the upper shaft; and a lower wheel via which the lower V-belt is configured to rotate the lower shaft.

In some embodiments, the upper slider crank mechanism further includes an upper frame connected to and rotatable by the upper shaft, the upper crank is positioned on the upper frame, the lower slider crank mechanism further includes a lower frame connected to and rotatable by the lower shaft, and the lower crank is positioned on the lower frame.

In some embodiments, the first motor is configured to rotate the middle pulley, which rotates the upper shaft via the upper V-belt and the upper wheel, which rotates the upper frame and the upper crank, which slides the upper piston along the inner surface of the upper cylinder, which adjusts a flow of the MR fluid, and the first motor is configured to rotate the middle pulley, which rotates the lower shaft via the lower V-belt and the lower wheel, which rotates the lower frame and the lower crank, which slides the lower piston along the inner surface of the lower cylinder, which adjusts the flow of the MR fluid.

In some embodiments, the apparatus further includes an upper reducer positioned between the upper cylinder and the magnet fixture; and a lower reducer positioned between the lower cylinder and the magnet fixture.

In some embodiments, the upper reducer is tapered and has a wider end facing the upper cylinder and a narrower end facing the magnet fixture, and the lower reducer is tapered and has a wider end facing the lower cylinder and a narrower end facing the magnet fixture.

In some embodiments, the apparatus further includes a belt drive via which the second motor is configured to rotate the magnet fixture.

In some embodiments, the magnet fixture includes a plurality of permanent magnets distributed along a circumference of the hole.

In some embodiments, the upper piston, the upper cylinder, the magnet fixture, the lower piston and the lower cylinder are arranged such that the MR fluid flows through the hole while being surrounded by the workpiece within the hole.

In some embodiments, the first motor is a 3-phase geared motor.

In another exemplary embodiment, a polishing system includes the apparatus and the MR fluid of preceding paragraphs.

In some embodiments, the MR fluid is in the form of a suspension of the ferromagnetic particles and the abrasive particles dispersed in the carrier fluid.

In some embodiments, the ferromagnetic particles include carbonyl iron particles, the abrasive particles include SiC particles and a lithium-based thickener dispersed in a base oil, and the carrier fluid includes paraffin oil.

In some embodiments, the carbonyl iron particles have an average diameter of 10-30 micrometers, and the SiC particles have an average diameter of 10-30 micrometers.

In some embodiments, the carbonyl iron particles are present in an amount of 1-20 vol. %, the abrasive particles are present in an amount of 1-20 vol. %, and the carrier fluid is present in an amount of 60-98 vol. %, relative to the total volume of the MR fluid.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings.

DETAILED DESCRIPTION

Figure 1A:
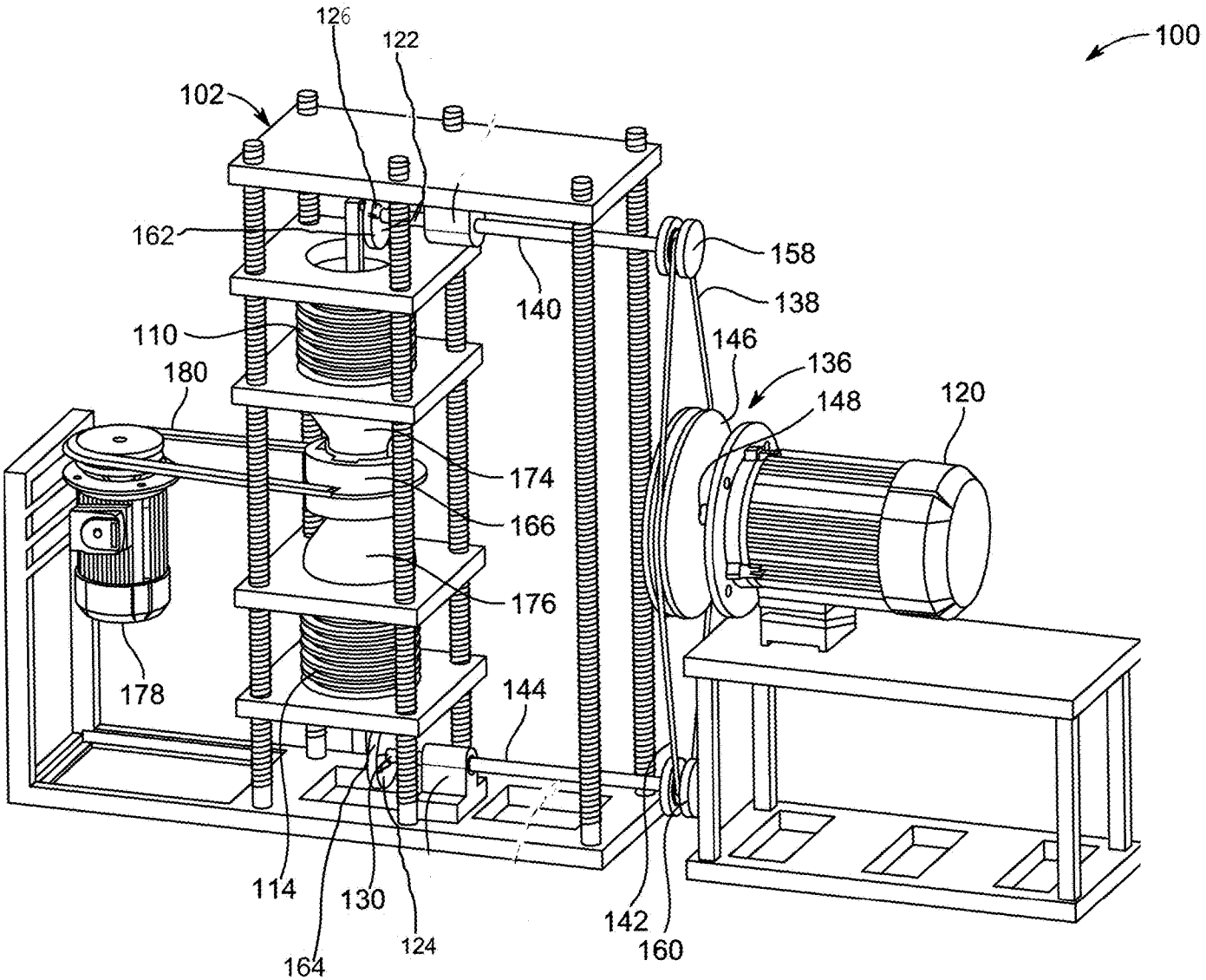
FIG. 1A is a perspective view of an apparatus for implementing Reciprocating and Rotational Magnetorheological Abrasive Flow Nano-Finishing (RR-MRAFNF), according to certain embodiments.
Figure 1B:
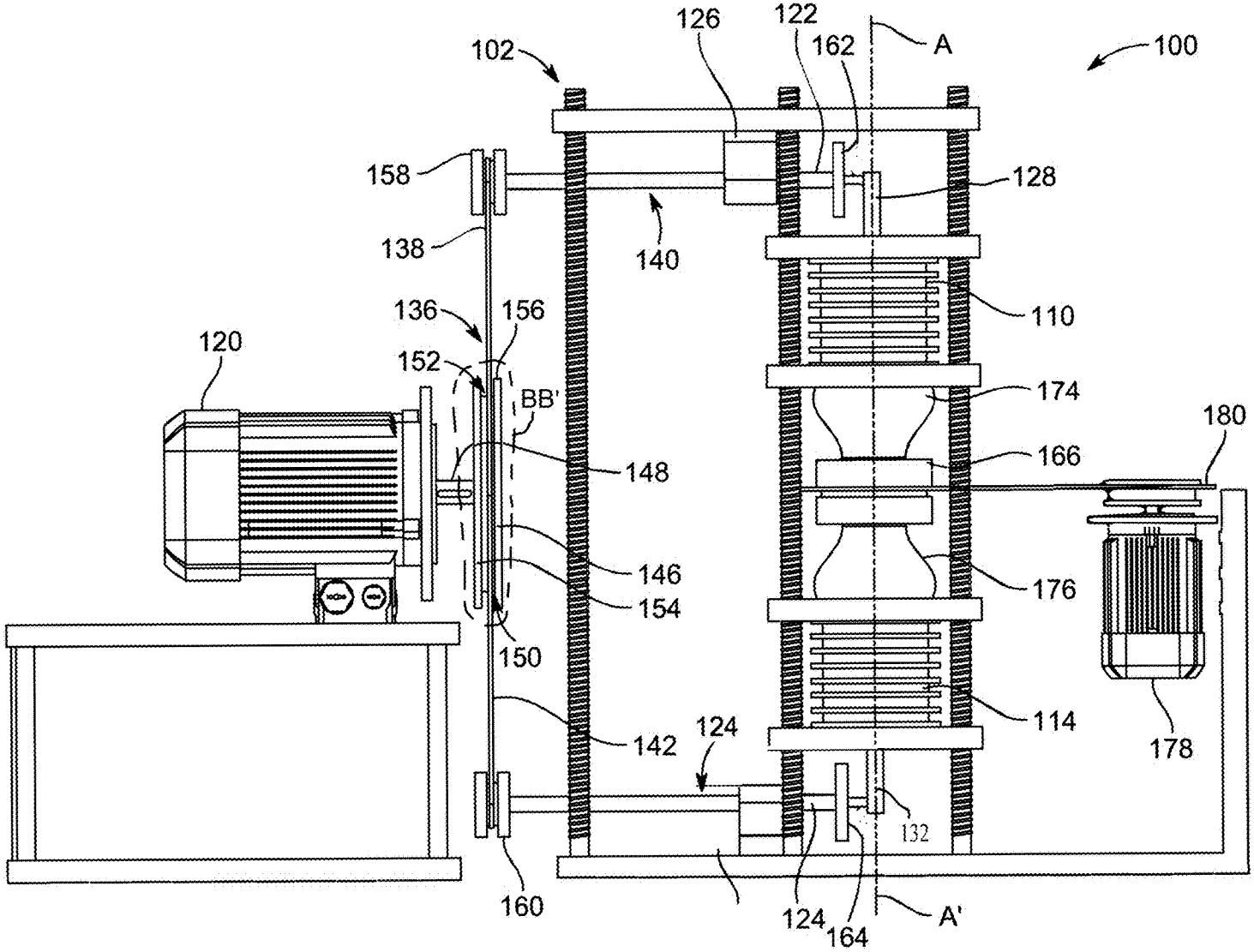
FIG. 1B is a backside view of the apparatus, according to certain embodiments.
Figure 1C:
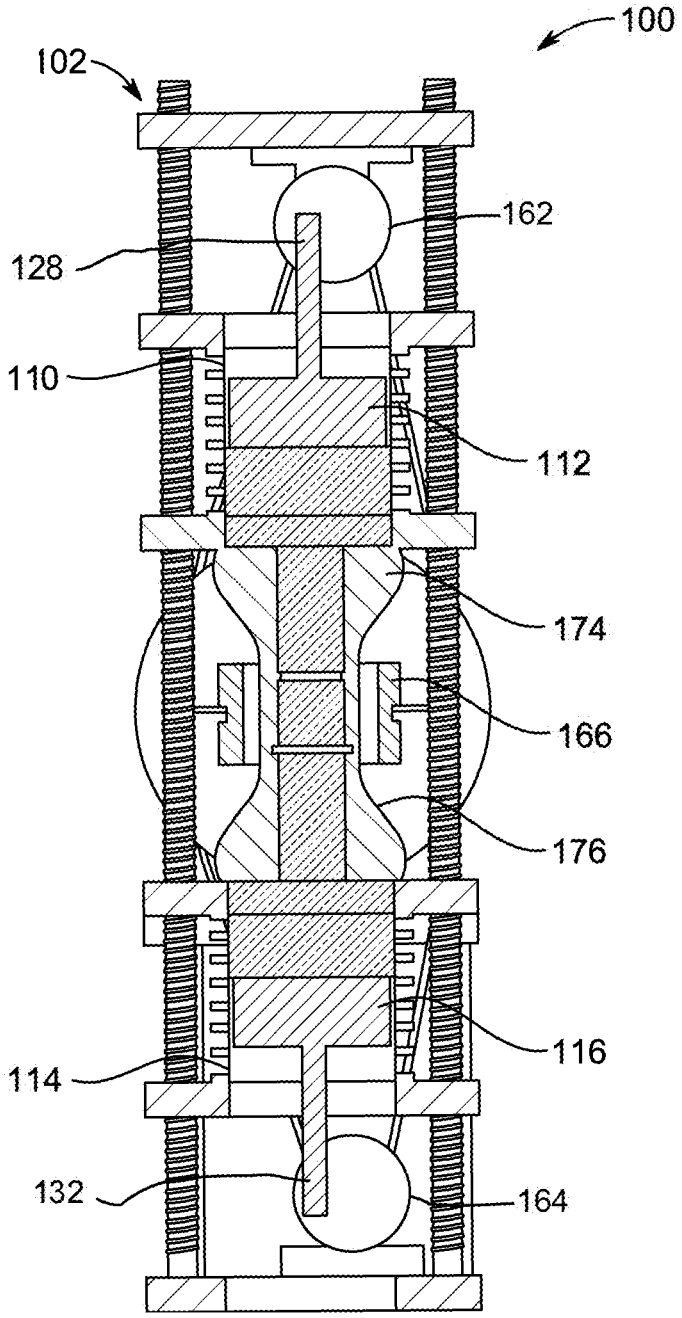
FIG. 1C is an exemplary cross-section view of the apparatus along an axis AA' of FIG. 1B, illustrating its internal configuration and component arrangement, according to certain embodiments.
Figure 1D:
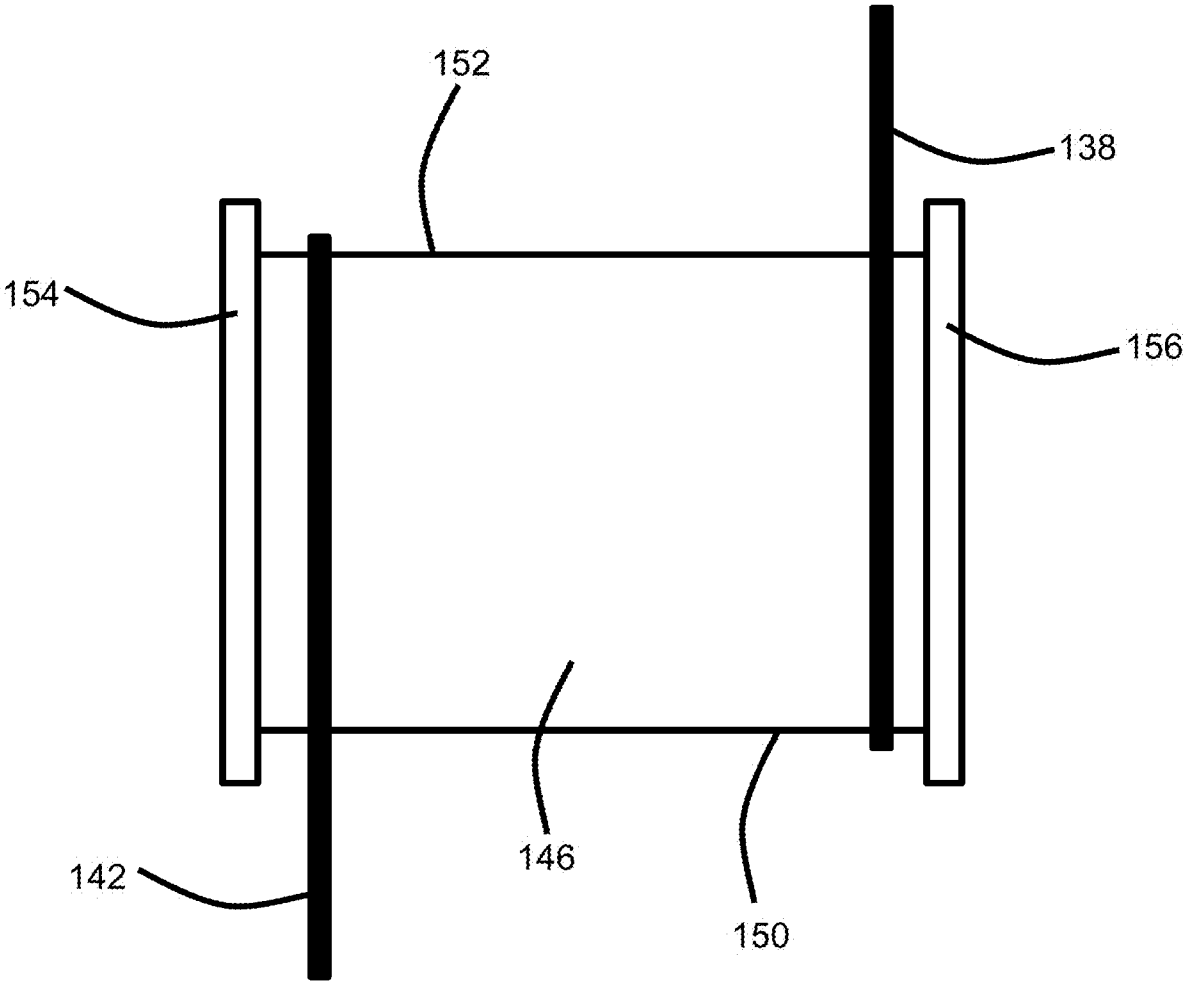
FIG. 1D shows an expanded view of an area BB' of FIG. 1B, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

Aspects of this disclosure are directed to an apparatus and a polishing system that integrate magnetorheological fluid technology with mechanical systems to achieve superior surface finishing capabilities. The present disclosure combines controlled fluid dynamics with magnetic field manipulation to enable material removal at the nano-scale level. This integration enables dynamic control over the finishing process through coordinated actuation of multiple subsystems, resulting in enhanced surface quality and improved process efficiency. The architecture for the apparatus and the polishing system incorporates advanced motion control mechanisms that work in coordination with magnetic field manipulation to achieve desirable and reliable surface finishing outcomes.

Referring to FIGS. 1A-1D, illustrated are different views of an apparatus (as represented by reference numeral 100) implementing Reciprocating and Rotational Magnetorheological Abrasive Flow Nano-Finishing (RR-MRAFNF) process. The apparatus 100 integrates multiple technological domains, combining principles of fluid mechanics, magnetorheology, and motion control into a unified architecture. This multi-component configuration enables controlled manipulation of finishing media through coordinated mechanical and magnetic actuation, facilitating controlled material removal at microscopic or nanoscopic scales. The apparatus 100 provides operational flexibility, allowing adaptation to various workpiece geometries and material compositions, while maintaining consistent performance characteristics. The apparatus 100 is suited for advanced manufacturing processes requiring nano-scale precision, including aerospace component manufacturing, medical device fabrication, and precision tooling, where surface quality directly impacts functional performance.

As illustrated, the apparatus 100 includes a main support frame (referred to as a frame 102 hereinafter) constructed to provide structural stability and alignment of mechanical components. The frame 102 includes vertical support members and horizontal cross members configured to maintain dimensional stability during operation. The frame 102 may also include mounting points designed to accommodate drive system components and fluid handling assemblies while suppressing operational vibration. The structural elements of the frame 102 are dimensioned and arranged to ensure proper alignment between its upper assembly and lower assembly during synchronized operation, as discussed in detail later in the present disclosure.

The apparatus 100 includes an upper cylinder 110. The upper cylinder 110 forms part of the upper assembly, supported in the frame 102. The apparatus 100 also includes an upper piston 112 coupled with the upper cylinder 110. Herein, the upper piston 112 is configured to slide along an inner surface of the upper cylinder 110. The upper cylinder 110 may incorporate fluid ports positioned to enable controlled flow of a fluid therein. The upper piston 112 may also include sealing elements designed to maintain pressure during reciprocating motion and prevent fluid bypass or leakage. The upper cylinder 110 and the upper piston 112 are dimensionally matched to prevent fluid bypass or leakage.

The apparatus 100 further includes a lower cylinder 114. The lower cylinder 114 forms part of the lower assembly, mirroring the upper configuration in the frame 102. The apparatus 100 also includes a lower piston 116 coupled with the lower cylinder 114. The lower piston 116 is configured to have sliding characteristics and pressure retention capabilities, similar to the upper assembly. The lower cylinder 114 may incorporate fluid ports positioned symmetrically with respect to the upper assembly to ensure balanced fluid flow. The lower piston 116 may also include sealing elements designed to maintain operational pressure integrity. The lower cylinder 114 and the lower piston 116 are configured to operate in synchronized motion with the upper assembly through mechanical linkages, maintaining a consistent phase relationship during reciprocating motion cycles.

The apparatus 100 further includes a first motor 120 configured to slide the upper piston 112 along an inner surface of the upper cylinder 110 via an upper slider crank mechanism 122 and slide the lower piston 116 along an inner surface of the lower cylinder 114 via a lower slider crank mechanism 124. The first motor 120 is configured to drive synchronized reciprocating motion of both the upper piston 112 and the lower piston 116. The first motor 120 is mechanically coupled to the upper slider crank mechanism 122 and the lower slider crank mechanism 124 through a synchronized drive system.

In some embodiments, the first motor 120 is a 3-phase geared motor and for example configured as the three-phase geared motor rated at 1.5 horsepower with an operational speed of 400 RPM. The geared configuration of the first motor 120 ensures stable torque delivery across the operational range while maintaining necessary speed control required for synchronized reciprocating motion. The three-phase design provides reliable operation and consistent power delivery required for continuous industrial applications.

Further, in some embodiments, the upper slider crank mechanism 122 includes an upper crank 126 and an upper connecting rod 128 coupled with the upper crank 126 and connected to the upper piston 112. The upper crank 126 is dimensioned to provide the required stroke length for the upper piston 112, converting rotational motion from the first motor 120 into linear reciprocating movement. The upper connecting rod 128 is designed with appropriate length and bearing interfaces to maintain smooth operation during the motion cycle. Similarly, the lower slider crank mechanism 124 includes a lower crank 130 and a lower connecting rod 132 coupled with the lower crank 130 and connected to the lower piston 116. Herein, the lower slider crank mechanism 124 mirrors the configuration of the upper slider crank mechanism 122, providing identical functionality for converting rotational motion from the first motor 120 into corresponding linear reciprocating movement.

In some embodiments, the apparatus 100 further includes a middle pulley 136 configured to be rotated by the first motor 120. The middle pulley 136 is dimensionally configured to provide mechanical advantage and speed reduction characteristics required for synchronized operation of both upper and lower assemblies. The design of the middle pulley 136 incorporates machined grooves to ensure belt engagement and suppress operational slip. The apparatus 100 also includes an upper V-belt 138 coupled with the middle pulley 136. The apparatus 100 also includes an upper shaft 140 coupled with the upper V-belt 138 and the upper crank 126 and configured to be rotated by the middle pulley 136 via the upper V-belt 138 so as to rotate the upper crank 126. Herein, the upper shaft 140 may be supported by bearings to maintain rotational alignment and suppress mechanical vibration during operation. The apparatus 100 further includes a lower V-belt 142 coupled with the middle pulley 136. The apparatus 100 also includes a lower shaft 144 coupled with the lower V-belt 142 and the lower crank 130 and configured to be rotated by the middle pulley 136 via the lower V-belt 142 so as to rotate the lower crank 130. The lower V-belt 142 and the lower shaft 144 can mirror the configuration of the upper assembly to maintain mechanical symmetry in the apparatus 100, incorporating similar or identical material specifications and dimensional characteristics for consistent performance.

In some embodiments, the upper V-belt 138 and the lower V-belt 142 are staggered along the middle pulley 136 so that the first motor 120 is configured to rotate the upper shaft 140 and the lower shaft 144 synchronously and slide the upper piston 112 and the lower piston 116 synchronously.

As shown, the middle pulley 136 includes a middle wheel 146 and a middle shaft 148 connecting the middle wheel 146 to the first motor 120. Further, the middle wheel 146 is oriented to have an upper rotating surface 152 and a lower rotating surface 150 and have two opposite sides 154, 156 along a longitudinal direction of the middle shaft 148. The upper rotating surface 152 and the lower rotating surface 150 are machined with groove profiles (not shown) designed to accommodate V-belt configurations. The two opposite sides 154, 156 of the middle wheel 146 are perpendicular to the middle shaft 148, ensuring proper belt tracking during operation.

Additionally, the upper V-belt 138 is in direct contact with the lower rotating surface 150 of the middle wheel 146 and positioned on one of the two opposite sides 154, 156 of the middle wheel 146. This configuration ensures belt tension and alignment for efficient power transmission to the upper assembly. The lower V-belt 142 is in direct contact with the upper rotating surface 152 of the middle wheel 146 and positioned on another one of the two opposite sides 154, 156 of the middle wheel 146. This staggered arrangement of the upper V-belt 138 and the lower V-belt 142 along opposite sides of the middle wheel 146 facilitates balanced power distribution while maintaining synchronization between upper and lower assemblies.

The apparatus 100 further includes an upper wheel 158 via which the upper V-belt 138 is configured to rotate the upper shaft 140, and a lower wheel 160 via which the lower V-belt 142 is configured to rotate the lower shaft 144. The upper wheel 158 incorporates V-grooves designed to match specifications of the upper V-belt 138 and ensure efficient power transfer from the middle pulley 136 to the upper shaft 140. Similarly, the lower wheel 160 incorporates V-grooves designed to match specifications of the lower V-belt 142 and ensure efficient power transfer from the middle pulley 136 to the lower shaft 144.

In some embodiments, the upper slider crank mechanism 122 further includes an upper frame 162 connected to and rotatable by the upper shaft 140. The upper crank 126 is positioned on the upper frame 162. Such positioning is done with radial offset to generate required stroke length for the upper piston 112. Similarly, the lower slider crank mechanism 124 includes a lower frame 164 connected to and rotatable by the lower shaft 144. The lower crank 130 is positioned on the lower frame 164, mirroring the configuration of the upper crank 126 to maintain synchronized reciprocating motion between upper and lower assemblies.

Figure 2A:
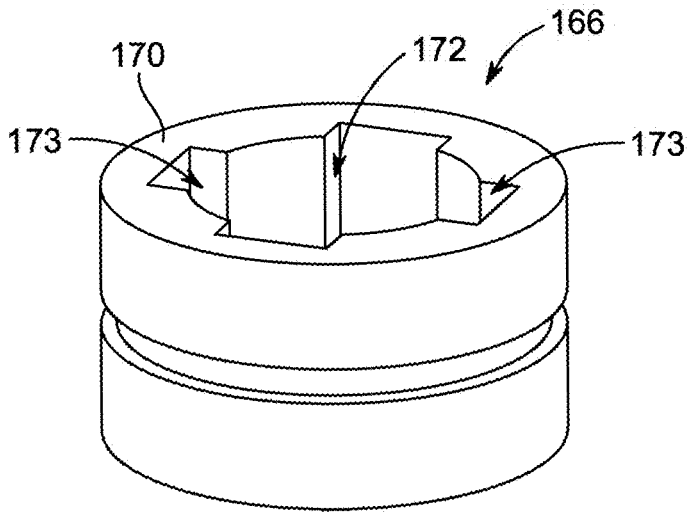
FIG. 2A is an exemplary perspective view of a magnet fixture of the apparatus, without permanent magnets therein, according to certain embodiments.
Figure 2B:
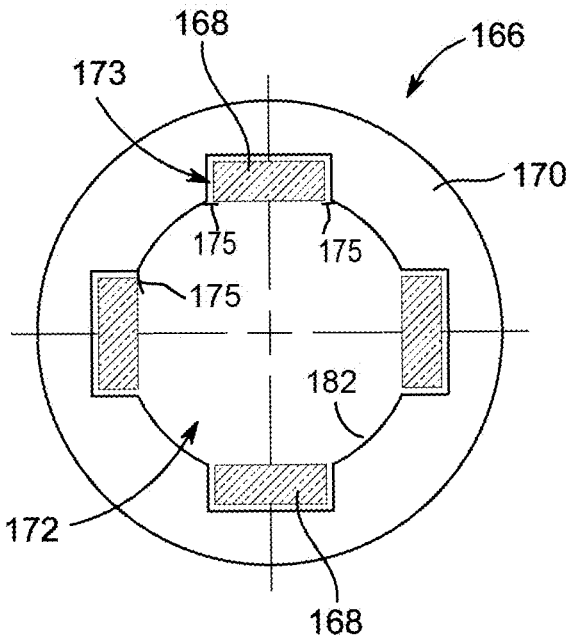
FIG. 2B is an exemplary top view of the magnet fixture, illustrating symmetrical arrangement of permanent magnet in slots defined therein, according to certain embodiments.

Further, as illustrated, the apparatus 100 includes a magnet fixture 166 positioned between the upper cylinder 110 and the lower cylinder 114. FIGS. 2A and 2B illustrate different views of the magnet fixture 166. The magnet fixture 166 includes at least one permanent magnet 168 and has a shape of a ring 170 and a hole 172 in the ring 170 configured to receive a workpiece 182 therein. In an embodiment, the magnet fixture 166 includes a plurality of permanent magnets 168 distributed along a circumference of the hole 172. As shown in FIGS. 2A-2B, the magnet fixture 166 is configured with rectangular slots 173 distributed along a circumference of the ring 170. Herein, each slot 173 is dimensioned to accommodate a respective permanent magnet 168. In an example configuration, the slots 173 are rectangular in shape, with each slot 173 dimensioned to accommodate a rectangular permanent magnet 168.

In some embodiments, the permanent magnets 168 are exposed to the hole 172, meaning that the slots 173 and the hole 173 are connected to each other. For instance, at least one surface of each of the permanent magnets 168 can be on a circular circumference of the (circular) hole 172 or extends into the hole 172 to occupy a portion of the hole 172 defined by the circular circumference. The permanent magnets 168 can be physically held or fastened for example by one or more pin structures 175 (or clamp structures) positioned at ends of the slots 173. The pin structures 175 can be designed to be non-magnetic and include a dielectric material for example. In some embodiments, the slots 173 are disconnected from the hole 172. For instance, the slots 173 can be sealed by a partition wall (not shown) near (e.g. at, inside or outside) the circular circumference of the hole 172. Note that the pin structures 175 can reduce magnetic loss or interference, compared with a full-sized partition wall to seal off the slots 173.

TABLE 1

A non-limiting example of component specifications

| Reference Numeral | Model | Quantity | Specifications |
|---|---|---|---|
| 120 | 3 phase AC geared motor | 1 | 1.5 HP, 400 RPM |
| 178 | 3 phase AC geared motor | 1 | 0.5 HP, 400 RPM |
| 110, 114 | Cylinder | 2 | Bore diameter 8.5 cm, Stroke 10 cm |
| 140, 144 | Shaft | 2 | Diameter 2.5 cm, Length 60 cm |
| 138, 142 | Pulley single V groove | 2 | Outer diameter 10 cm, Inner diameter 2.5 cm |
| 138, 142 | V belt | 2 | Length 120 cm |
| 146 | Pulley double V groove | 1 | Outer diameter 15 cm, Inner diameter 3.5 cm |
| 174, 176 | IC reducers | 2 | Wide end diameter 8.5 cm, Narrow end diameter 4 cm, Length 10 cm |
| 166 | Magnet fixture | 2 | Diameter 16 cm, 4 magnet slots |
| 168 | Magnet N42 | 4 | 5 × 5 × 2.5 cm, Energy product 318-334 kJ/m$^3$ |

In a non-limiting example as shown in Table 1 above, the permanent magnets 168 are N42 grade with dimensions of 50 millimeters in height and 20 millimeters in both length and width, generating a magnetic field strength of 0.4 Tesla. The N42 grade permanent magnets have an energy product of 318-334 kJ/m$^3$, providing consistent magnetic field strength necessary for controlling the MR fluid viscosity during operation. The magnetic field strength can be symmetrical or uniform across the finishing zone due to the symmetrical arrangement of the permanent magnets 168 within the magnet fixture 166. The ring 170 has an outer diameter of 160 millimeters and incorporates four symmetrically positioned slots 173 for magnet placement. The hole 172 maintains concentricity with an outer diameter of the ring 170, ensuring uniform magnetic field distribution around the workpiece 182. The magnet fixture 166 is constructed from non-magnetic materials to prevent interference with the magnetic field generated by the permanent magnets 168 during operation. The placement of the magnet fixture 166 between the upper cylinder 110 and the lower cylinder 114 enables direct magnetic field interaction with the fluid flowing through the hole 172 (as discussed in the proceeding paragraphs). Opposite magnetic poles of the permanent magnets 168 can be arranged to face each other.

Magnetic poles of the permanent magnets 168 can be oriented in various directions depending on specific design needs. In some embodiments, magnetic poles of the permanent magnets 168 are at opposite ends of the slots 173 along a longitudinal direction of the slots 173 or substantially parallel to a circumference of the hole 182. An N pole of one of the permanent magnets 168 can face an S pole of a neighboring one of the permanent magnets 168. An S pole of the one of the permanent magnets 168 can face an N pole of another neighboring one of the permanent magnets 168.

In some embodiments, magnetic poles of the permanent magnets 168 are oriented to face or face away from the hole 172. For instance, an N pole of one of the permanent magnets 168 can face the hole 172 while an S pole of the one of the permanent magnets 168 can face away from the hole 172, or vice versa. In the example of FIG. 2B where there are four permanent magnets, an S pole of an opposite one of the permanent magnets 168 can face the hole 172. As a result, the N pole of one of the permanent magnets 168 can face the S pole of an opposite one (not the two neighboring ones) of the permanent magnets 168. For instance, in a clockwise direction along a circular circumference of the hole 172, magnetic poles of the four permanent magnets 168 facing the circular circumference of the hole 172 can serially or sequentially be N, S, N and S.

Referring back to FIGS. 1A-1C, in some embodiments, the apparatus 100 further includes an upper reducer 174 positioned between the upper cylinder 110 and the magnet fixture 166, and a lower reducer 176 positioned between the lower cylinder 114 and the magnet fixture 166. The upper reducer 174 and the lower reducer 176 are dimensionally configured to provide controlled fluid flow transition between the cylinders 110, 114 and the magnet fixture 166. Herein, the reducers 174, 176 are fabricated from non-magnetic materials to maintain magnetic field integrity during operation. The upper reducer 174 and the lower reducer 176 include internal passages designed to maintain laminar flow characteristics of the said fluid during transition between the cylinders 110, 114 and the magnet fixture 166.

In some embodiments, the upper reducer 174 is tapered and has a wider end facing the upper cylinder 110 and a narrower end facing the magnet fixture 166, and the lower reducer 176 is tapered and has a wider end facing the lower cylinder 114 and a narrower end facing the magnet fixture 166.

The apparatus 100 further includes a second motor 178 configured to rotate the magnet fixture 166 so as to rotate the at least one permanent magnet. In an example configuration, the second motor 178 is configured as a 0.5 horsepower geared motor operating at 400 RPM to provide controlled rotation of the magnet fixture 166. The second motor 178 is mounted on the frame 102 to maintain proper alignment with the magnet fixture 166 during operation. The rotational speed of the second motor 178 is regulated through a variable frequency drive to adjust the magnetic field rotation characteristics for various finishing requirements.

The apparatus 100 also includes a belt drive 180 via which the second motor 178 is configured to rotate the magnet fixture 166. The belt drive 180 incorporates one or more pulleys and tensioning mechanisms to ensure consistent power transmission from the second motor 178 to the magnet fixture 166, enabling control over the magnetic field orientation during the finishing process.

In some examples, the apparatus 100 further includes a first variable frequency drive configured to control the first motor 120 and a second variable frequency drive configured to control the second motor 178. The first variable frequency drive can be rated at e.g. 1.5 horsepower to match specifications of the first motor 120, while the second variable frequency drive can be rated at e.g. 0.5 horsepower to match specifications of the second motor 178. These variable frequency drives enable speed control and torque regulation of both motors 120, 178 during operation.

In the apparatus 100, the upper piston 112, the upper cylinder 110, the magnet fixture 166, the lower piston 116 and the lower cylinder 114 define an enclosed space configured to receive a fluid such as a magnetorheological (MR) fluid. The volumetric capacity of the space is configured to be matched to the stroke volume of the reciprocating pistons 112, 116, ensuring consistent fluid pressure during operation. In particular, the enclosed space incorporates fluid passages and transition zones between components to maintain uniform flow characteristics of the MR fluid. The interface regions between the upper cylinder 110 and the magnet fixture 166, and between the lower cylinder 114 and the magnet fixture 166 can be designed to prevent fluid bypass while enabling controlled flow through designated passages. The space may also include dedicated fluid ports for introduction and circulation of the MR fluid during operation.

The MR fluid can include ferromagnetic particles, abrasive particles and a carrier fluid. For instance, the ferromagnetic particles can be in the form of carbonyl iron particles having an average diameter of 10-30 micrometers, preferably 15-25 micrometers, preferably 17-23 micrometers, preferably 18 micrometers present in an amount of 1-20 volume percent (vol. %), preferably 3-15 vol. %, preferably 5-10 vol. % relative to a total volume of the MR fluid. The abrasive particles are in the form of silicon carbide (SiC) having a diameter of 10-30 micrometers, preferably 15-25 micrometers, preferably 17-23 micrometers, preferably 19 micrometers present in an amount of 1-20 vol. %, preferably 3-15 vol. %, preferably 5-10 vol. %, relative to the total volume of the MR fluid. The carrier fluid includes paraffin oil present in an amount of 60-98 vol. %, preferably 70-95 vol. %, preferably 80-90 vol. %, relative to the total volume of the MR fluid. The MR fluid may further include AP3 grease present in an amount of 5-20 vol. %, preferably 10-15 vol. %, preferably 12 volume percent. The AP3 grease can function as a thickening agent to enhance the stability and rheological properties of the MR fluid during operation. The combination of carbonyl iron particles, silicon carbide abrasive particles, AP3 grease, and paraffin oil carrier fluid can form a stable suspension that maintains consistent material removal characteristics during the finishing process.

Further, in the apparatus 100, the upper piston 112, the upper cylinder 110, the magnet fixture 166, the lower piston 116 and the lower cylinder 114 are arranged such that as the MR fluid flows through the hole 172 while being in direct contact with the workpiece 182 within the hole 172. Herein, the ferromagnetic particles in the MR fluid move rotationally and reciprocally (e.g. in both rotational and reciprocal directions). The rotational movement is induced by rotation of the magnet fixture 166 through the second motor 178, while the reciprocal movement results from synchronized motion of the upper piston 112 and the lower piston 116 driven by the first motor 120.

In some embodiments, the upper piston 112, the upper cylinder 110, the magnet fixture 166, the lower piston 116 and the lower cylinder 114 are arranged such that the MR fluid flows through the hole 172 while being surrounded by the workpiece 182 within the hole 172. In one example, the workpiece 182 may be positioned around and in direct contact with a sidewall of the hole 172. This arrangement enables circumferential contact between the MR fluid and the internal surface of the workpiece 182, facilitating uniform material removal along the workpiece circumference. The workpiece 182 can be secured concentrically within the hole 172 of the magnet fixture 166 through fixture interfaces. In another example, the workpiece 182 may be positioned around and not in direct contact with the sidewall of the hole 172. In other words, there is a gap or channel between the workpiece 182 and the sidewall of the hole 172 for the MR fluid to go through. The workpiece 182 can therefore be polished on both sides. The clearance between the outer diameter of the workpiece 182 and the inner diameter of the hole 172 is maintained to ensure proper fluid velocity and pressure distribution. The reducers 174, 176 are configured to direct the MR fluid flow radially inward toward the workpiece surface, establishing a continuous fluid flow around the workpiece circumference during operation. This arrangement, combined with the synchronized reciprocating motion and magnetic field rotation, enables uniform material removal across one or both surfaces of the workpiece 182.

In particular, the first motor 120 is configured to rotate the middle pulley 136, which rotates the upper shaft 140 via the upper V-belt 138 and the upper wheel 158, which rotates the upper frame 162 and the upper crank 126, which slides the upper piston 112 along the inner surface of the upper cylinder 110, which adjusts a flow of the MR fluid. That is, the rotation of the upper shaft 140 drives the rotation of the upper frame 162 and the upper crank 126, which in turn slides the upper piston 112 along the inner surface of the upper cylinder 110, thereby adjusting the flow of the MR fluid. Similarly, the first motor 120 is configured to rotate the middle pulley 136, which rotates the lower shaft 144 via the lower V-belt 142 and the lower wheel 160, which rotates the lower frame 164 and the lower crank 130, which slides the lower piston 116 along the inner surface of the lower cylinder 114, which adjusts the flow of the MR fluid. That is, the rotation of the lower shaft 144 drives the rotation of the lower frame 164 and the lower crank 130, which in turn slides the lower piston 116 along the inner surface of the lower cylinder 114, thereby adjusting the flow of the MR fluid. This synchronized mechanical system ensures coordinated reciprocating motion of both pistons 112, 116, maintaining uniform fluid flow characteristics throughout the finishing operation.

When exposed to the magnetic field generated by permanent magnets 168 in the magnet fixture 166, the ferromagnetic carbonyl iron particles align to form chain-like structures, increasing fluid viscosity in localized regions. This controlled viscosity modification, combined with the dual motion in both rotational and reciprocal directions, enables controlled material removal through mechanical interaction between abrasive particles and the workpiece surface(s). The reciprocating motion maintains a consistent fluid flow while the rotational movement ensures uniform distribution of abrasive particles in the finishing zone.

The present disclosure provides a polishing system that includes the apparatus 100 and the MR fluid. The polishing system utilizes the apparatus 100 of the present disclosure along with the magnetorheological fluid formulation for nano-scale surface finishing applications.

Herein, the MR fluid utilized is in the form of a suspension of the ferromagnetic particles and the abrasive particles dispersed in the carrier fluid. The ferromagnetic particles include carbonyl iron particles. The abrasive particles include SiC particles and a lithium-based thickener dispersed in a base oil. The carrier fluid includes paraffin oil. Also, the carbonyl iron particles have an average diameter of 10-30 micrometers, preferably 15-25 micrometers, preferably 17-23 micrometers, preferably 18 micrometers. The SiC particles have an average diameter of 10-30 micrometers, preferably 15-25 micrometers, preferably 17-23 micrometers, preferably 19 micrometers. Further, the carbonyl iron particles are present in an amount of 1-20 vol. %, preferably 3-15 vol. %, preferably 5-10 vol. %, relative to the total volume of the MR fluid. The abrasive particles are present in an amount of 1-20 vol. %, preferably 3-15 vol. %, preferably 5-10 vol. %, relative to the total volume of the MR fluid. The carrier fluid is present in an amount of 60-98 vol. %, preferably 70-95 vol. %, preferably 80-90 vol. %, relative to the total volume of the MR fluid. The magnetic response characteristics of the fluid can be matched to the 0.4 Tesla field strength generated by the N42 grade permanent magnets in the magnet fixture 166, ensuring controlled viscosity modification and particle alignment during operation.

Figure 3A:
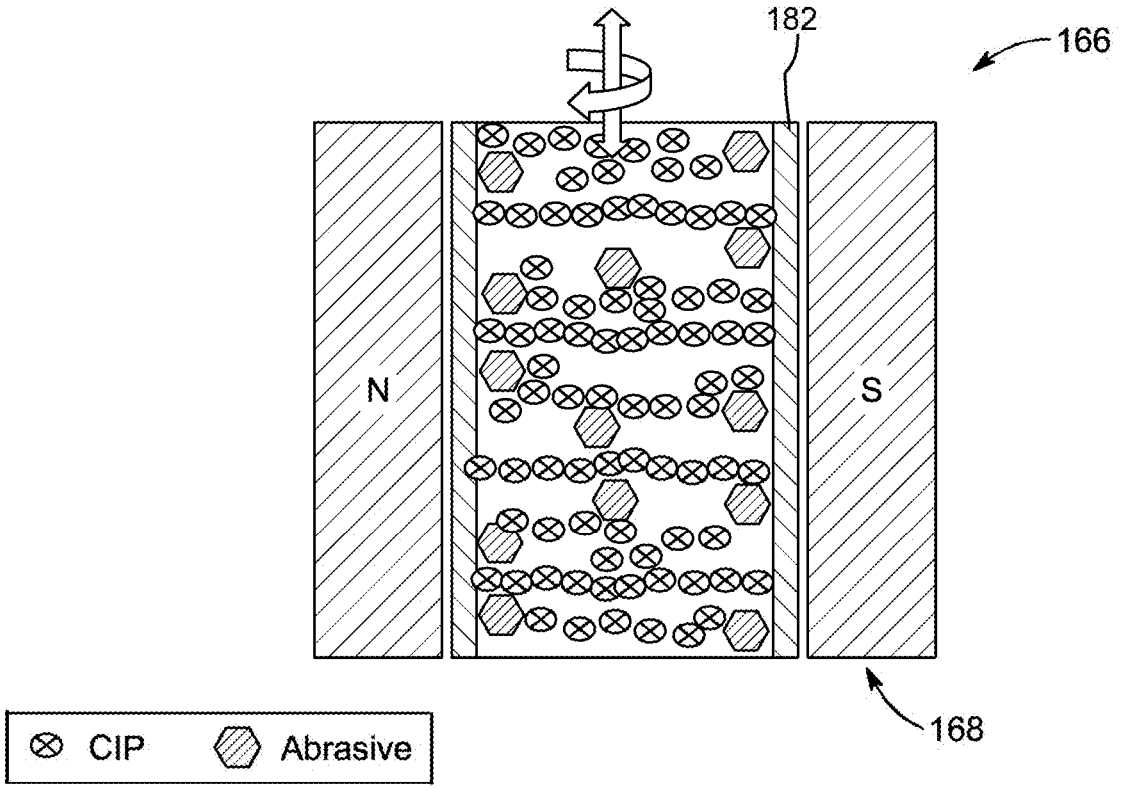
FIG. 3A is an exemplary sectional schematic representation of inside of the magnet fixture of the apparatus, according to certain embodiments.

Referring now to FIG. 3A, illustrated is a sectional schematic representation of inside of the magnet fixture 166 of the apparatus 100, depicting the arrangement of carbonyl iron particles (CIP) and abrasive particles in relation to permanent magnets 168 therein. The schematic shows permanent magnets 168 arranged with north (N) and south (S) poles positioned on opposite sides of a finishing zone. The MR fluid, containing a suspension of CIP and abrasive particles, is subjected to both media reciprocation and media rotation motions during operation. In a non-limiting example, the carbonyl iron particles, depicted by crossed elements, have an average diameter of 18 micrometers and are present in an amount of 1-20 volume percent. The abrasive particles, shown by shaded elements, include silicon carbide with a diameter of 19 micrometers present in an amount of 1-20 volume percent. The arrangement demonstrates the formation of chain-like structures by the CIP under the influence of the magnetic field, with abrasive particles distributed throughout the fluid medium.

Figure 3B:
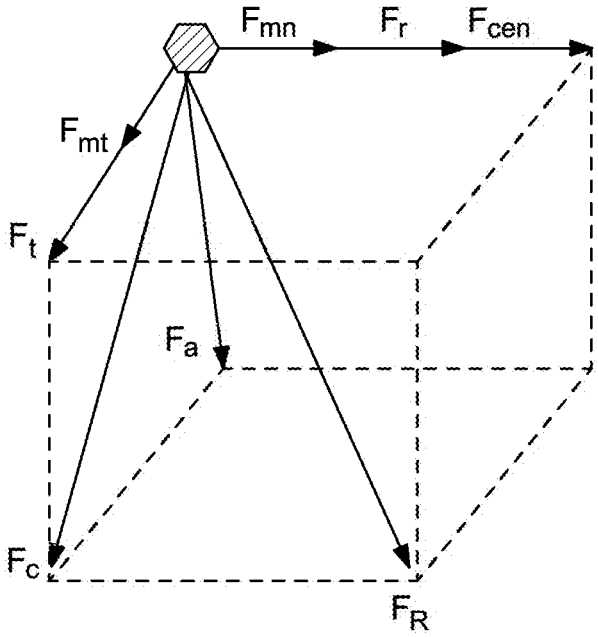
FIG. 3B is an exemplary force diagram depicting various components acting on an abrasive particle during an operation of the apparatus, according to certain embodiments.

FIG. 3B illustrates a force diagram depicting various force components acting on an abrasive particle during the finishing operation in the apparatus 100. As shown, herein, magnetic normal force ($F_{mn}$), radial force ($F_r$), and centrifugal force ($F_{cen}$) act normal to the workpiece surface. These forces combine to generate the indentation force responsible for particle engagement with the workpiece surface. Also, magnetic tangential force ($F_{mt}$), tangential cutting force ($F_t$), and axial force ($F_a$) contribute to the material removal process. Further, resultant force ($F_R$) and cutting force ($F_c$) represent the combined effect of these individual force components. The centrifugal force ($F_{cen}$) is expressed as $$F_{cen}=m(r\omega^2) \tag{1}$$

where m represents particle mass, r is radial distance, and co denotes angular velocity. The tangential cutting force ($F_t$) is defined as:

$$F_t=2m(\omega\times v) \tag{2}$$

where v represents linear velocity of the particle. This force distribution enables controlled material removal through controlled manipulation of the magnetorheological fluid properties and motion parameters.

So, there are three forces ($F_{mn}$, $F_r$ and $F_{cen}$) which act normal to the workpiece surface and are responsible for indenting the abrasives on the workpiece as given by equation (3) below. Further, Total cutting force ($F_c$) is given by equation (4) below.

$$\overrightarrow{F_{\text{indentation}}}=\overrightarrow{F_{\text{mn}}}+\overrightarrow{F_{\text{r}}}+\overrightarrow{F_{\text{cen}}} \tag{3}$$

$$\overrightarrow{F_{\text{c}}}=\overrightarrow{F_{\text{t}}}+\overrightarrow{F_{\text{a}}}+\overrightarrow{F_{\text{mt}}} \tag{4}$$

Figure 4:
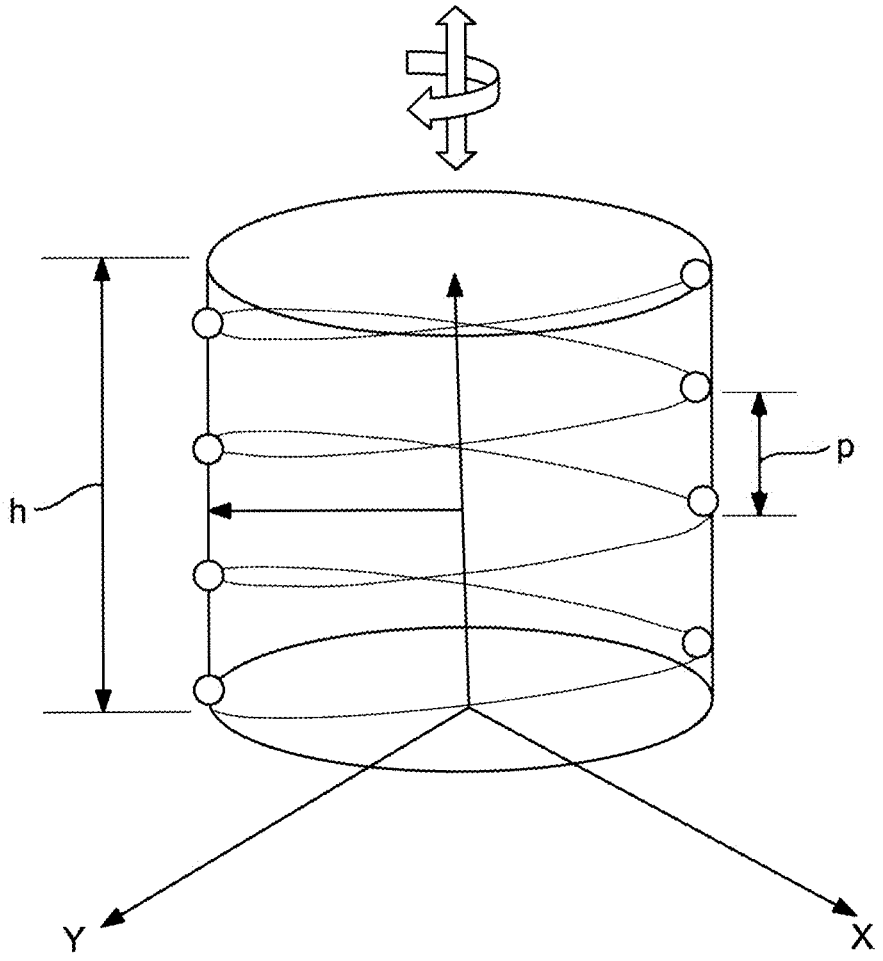
FIG. 4 is an exemplary schematic representation of a helical path followed by abrasive particles during the finishing operation, according to certain embodiments.

FIG. 4 illustrates a schematic representation of a helical path followed by abrasive particles during the finishing operation in the apparatus 100. As shown, this helical path is the result of the combined effect of media reciprocation and media rotation on particle trajectory within the MR fluid. Herein, X and Y coordinates are used to illustrate the spatial distribution of particle movement within the finishing zone. Further, height (h) represents a vertical distance traversed by abrasive particles during reciprocating motion, corresponding to the stroke length maintained by the synchronized motion of the upper piston 112 and the lower piston 116; and a pitch of helix (p) represents the vertical distance between successive helical turns, determined by the relationship between the reciprocating frequency of the pistons and the rotational speed of the magnet fixture 166. The abrasive particles follow this helical path due to the resultant force of axial reciprocation provided by the first motor 120 and rotational motion induced by the second motor 178. This helical motion pattern ensures uniform material removal across the workpiece surface through consistent distribution of abrasive particles and balanced force application throughout the finishing operation.

Figure 5A:
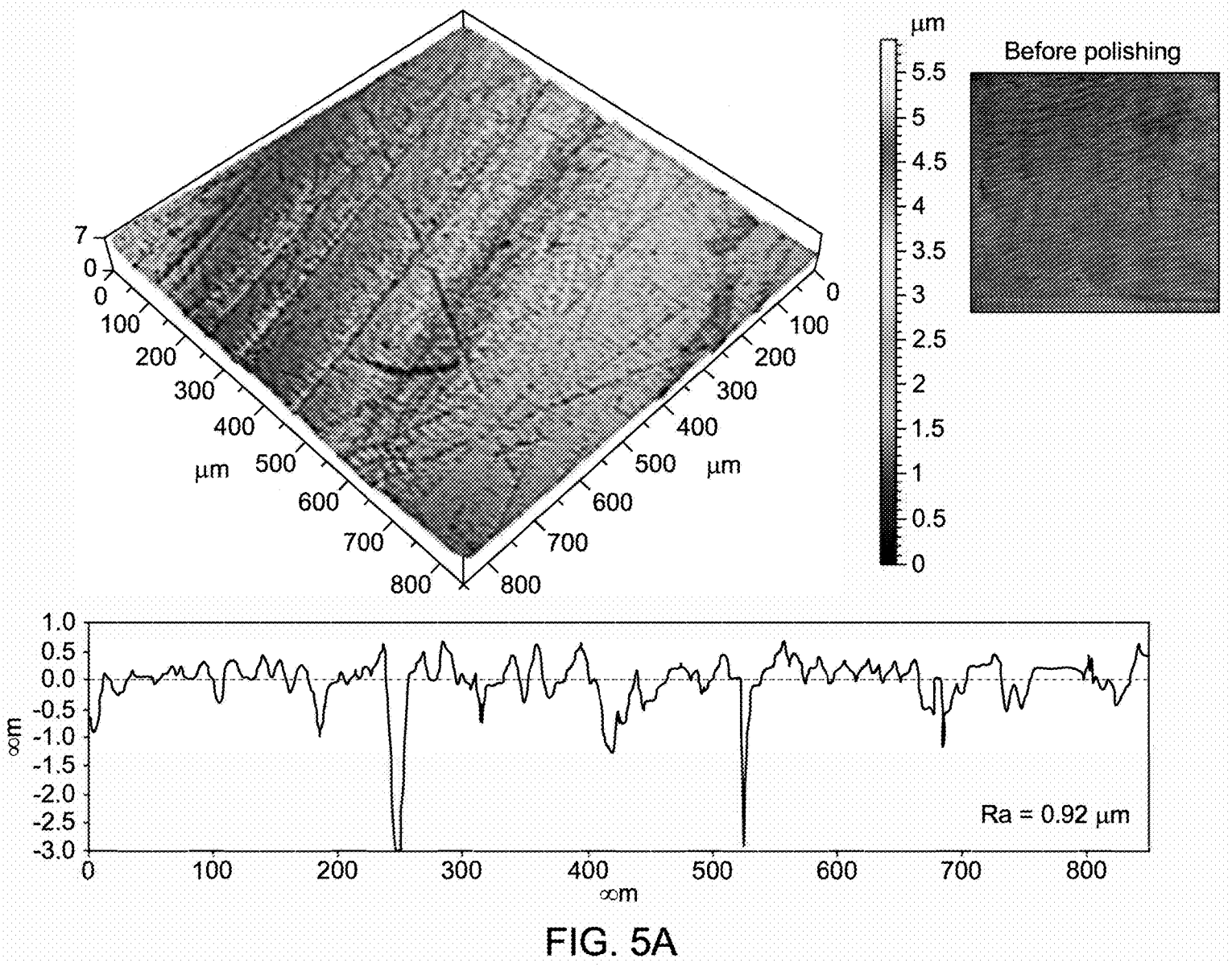
FIG. 5A is an exemplary depiction of surface topography analysis of a workpiece before polishing, according to certain embodiments.

FIG. 5A illustrates surface topography analysis of a workpiece before being processed by the apparatus 100. The three-dimensional surface map reveals the initial surface characteristics. The image indicates significant surface irregularities in the pre-processed state. The accompanying surface roughness profile graph demonstrates peak-to-valley variations with a measured arithmetic average roughness ($R_a$) value of 0.92 micrometers. The graph exhibits sharp peaks and valleys characteristic of machining marks and surface irregularities. The inset microscopy image provides visual confirmation of the surface condition before polishing, displaying distinct tool marks and surface pattern irregularities across the measured region.

Figure 5B:
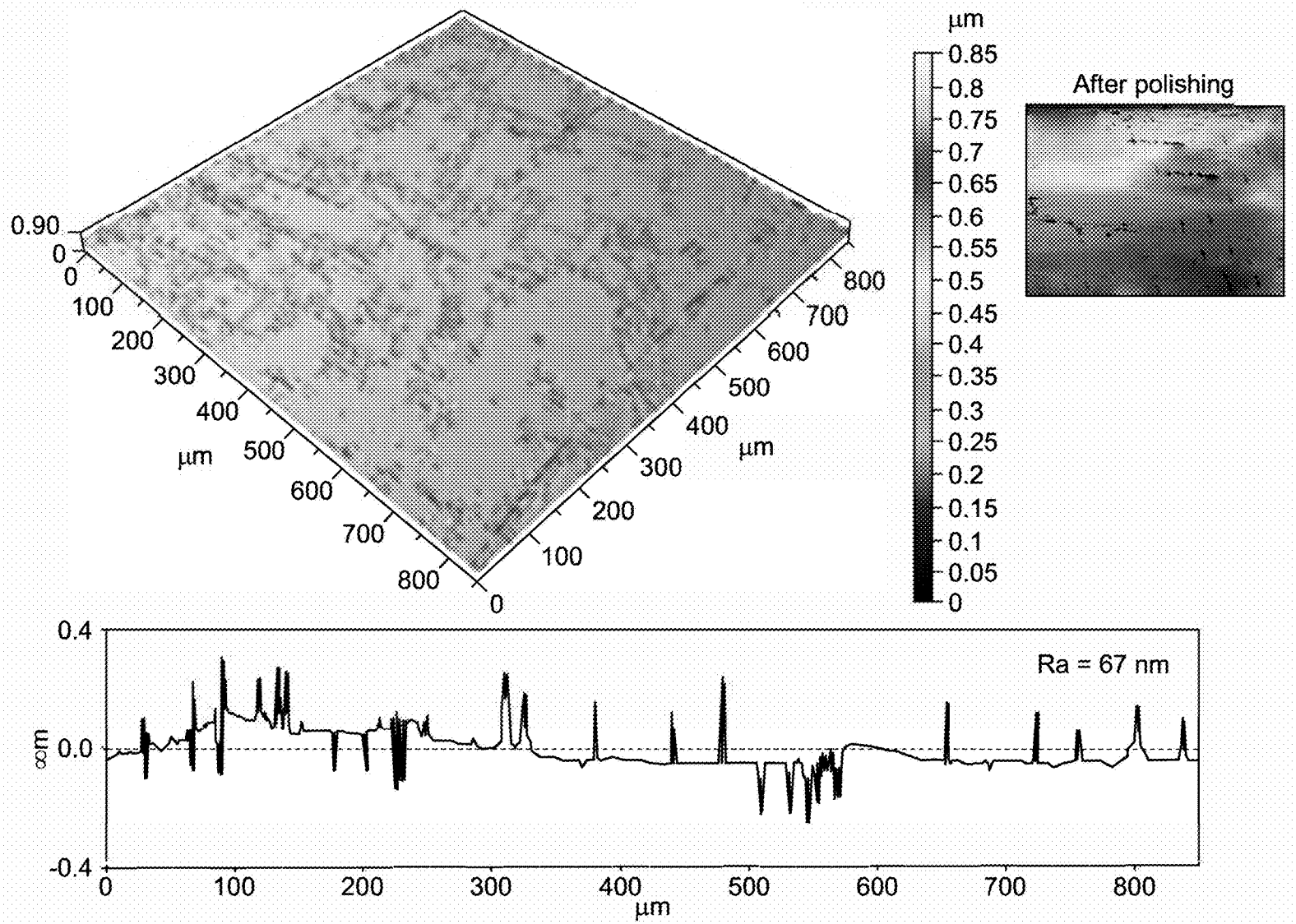
FIG. 5B is an exemplary comparative surface topography analysis after being polished by the present apparatus, according to certain embodiments.

FIG. 5B illustrates surface topography analysis of the workpiece after being processed by the apparatus 100. The three-dimensional topography map shows significant reduction in surface irregularities. The image, with reduced vertical measurement scale, reflects the substantial improvement in surface uniformity. The surface roughness profile also demonstrates marked reduction in peak-to-valley variations, with the measured arithmetic average roughness ($R_a$) value reduced to 67 nanometers. The profile graph shows substantially reduced amplitude of surface variations and elimination of sharp peaks, indicating effective material removal and surface smoothing. The inset microscopy image confirms the mirror-like surface finish achieved through the nano-finishing process, with no visible surface pattern irregularities. This demonstrates achieved surface finish improvements through the rotational magnetorheological abrasive flow nano-finishing process.

The apparatus 100 of the present disclosure can provide capability to reduce surface roughness by up to 80 percent in tested components. In some implementations, the apparatus 100 achieves reduction in arithmetic average roughness ($R_a$) from 0.92 micrometers to 67 nanometers, representing significant improvement in surface quality. This surface finish enhancement is achieved through controlled material removal facilitated by the manipulation of the MR fluid properties and synchronized motion control of the mechanical components.

Numerous modifications and variations of the present disclosure are possible in light of the above teachings. It is therefore to be understood that within the scope of the appended claims, the invention may be practiced otherwise than as specifically described herein.

The invention claimed is:

1. An apparatus, comprising:

an upper cylinder;

an upper piston coupled with the upper cylinder;

a lower cylinder;

a lower piston coupled with the lower cylinder;

a first motor configured to slide the upper piston along an inner surface of the upper cylinder via an upper slider crank mechanism and slide the lower piston along an inner surface of the lower cylinder via a lower slider crank mechanism;

a magnet fixture positioned between the upper cylinder and the lower cylinder, comprising at least one permanent magnet, and having a shape of a ring and a hole in the ring configured to receive a workpiece therein; and a second motor configured to rotate the magnet fixture so as to rotate the at least one permanent magnet, wherein the upper piston, the upper cylinder, the magnet fixture, the lower piston and the lower cylinder define a space that is configured to receive a magnetorheological (MR) fluid comprising ferromagnetic particles, abrasive particles and a carrier fluid, and the upper piston, the upper cylinder, the magnet fixture, the lower piston and the lower cylinder are arranged such that as the MR fluid flows through the hole while being in direct contact with the workpiece within the hole, the ferromagnetic particles in the MR fluid move rotationally and reciprocally, wherein the upper slider crank mechanism comprises an upper crank and an upper connecting rod coupled with the upper crank and connected to the upper piston, and wherein the lower slider crank mechanism comprises a lower crank and a lower connecting rod coupled with the lower crank and connected to the lower piston;

a middle pulley configured to be rotated by the first motor;

an upper V-belt coupled with the middle pulley;

an upper shaft coupled with the upper V-belt and the upper crank and configured to be rotated by the middle pulley via the upper V-belt so as to rotate the upper crank;

a lower V-belt coupled with the middle pulley; and a lower shaft coupled with the lower V-belt and the lower crank and configured to be rotated by the middle pulley via the lower V-belt so as to rotate the lower crank.

2. The apparatus of claim 1, wherein:

the magnet fixture comprises slots distributed along a circumference of the hole and permanent magnets positioned in the slots.

3. The apparatus of claim 2, wherein:

the hole is circular, the slots are rectangular, the permanent magnets are rectangular, each permanent magnet is positioned in a respective slot and has a respective magnetic pole facing the circumference of the hole and another respective magnetic pole facing away from the circumference of the hole.

4. The apparatus of claim 3, wherein:

the magnet fixture comprises pin structures positioned at end positions of the slots, and the permanent magnets extend into a circular circumference of the hole.

5. The apparatus of claim 1, wherein:

the upper V-belt and the lower V-belt are staggered along the middle pulley so that the first motor is configured to rotate the upper shaft and the lower shaft synchronously and slide the upper piston and the lower piston synchronously.

6. The apparatus of claim 5, wherein:

the middle pulley comprises a middle wheel and a middle shaft connecting the middle wheel to the first motor, and the middle wheel is oriented to have an upper rotating surface and a lower rotating surface and have two opposite sides along a longitudinal direction of the middle shaft.

7. The apparatus of claim 6, wherein:

the upper V-belt is in direct contact with the lower rotating surface of the middle wheel and positioned on one of the two opposite sides of the middle wheel, and the lower V-belt is in direct contact with the upper rotating surface of the middle wheel and positioned on another one of the two opposite sides of the middle wheel.

8. The apparatus of claim 1, further comprising:

an upper wheel via which the upper V-belt is configured to rotate the upper shaft; and a lower wheel via which the lower V-belt is configured to rotate the lower shaft.

9. The apparatus of claim 8, wherein:

the upper slider crank mechanism further comprises an upper frame connected to and rotatable by the upper shaft, the upper crank is positioned on the upper frame, the lower slider crank mechanism further comprises a lower frame connected to and rotatable by the lower shaft, and the lower crank is positioned on the lower frame.

10. The apparatus of claim 9, wherein:

the first motor is configured to rotate the middle pulley, which rotates the upper shaft via the upper V-belt and the upper wheel, which rotates the upper frame and the upper crank, which slides the upper piston along the inner surface of the upper cylinder, which adjusts a flow of the MR fluid, and the first motor is configured to rotate the middle pulley, which rotates the lower shaft via the lower V-belt and the lower wheel, which rotates the lower frame and the lower crank, which slides the lower piston along the inner surface of the lower cylinder, which adjusts the flow of the MR fluid.

11. The apparatus of claim 1, further comprising:

an upper reducer positioned between the upper cylinder and the magnet fixture; and a lower reducer positioned between the lower cylinder and the magnet fixture, wherein the upper reducer is tapered and has a wider end facing the upper cylinder and a narrower end facing the magnet fixture, and the lower reducer is tapered and has a wider end facing the lower cylinder and a narrower end facing the magnet fixture.

12. The apparatus of claim 1, further comprising:

a belt drive via which the second motor is configured to rotate the magnet fixture.

13. The apparatus of claim 1, wherein:

the upper piston, the upper cylinder, the magnet fixture, the lower piston and the lower cylinder are arranged such that the MR fluid flows through the hole while being surrounded by the workpiece within the hole.

14. The apparatus of claim 1, wherein:

the MR fluid is in the form of a suspension of the ferromagnetic particles and the abrasive particles dispersed in the carrier fluid.

15. The apparatus of claim 1, wherein:

the ferromagnetic particles comprise carbonyl iron particles, the abrasive particles comprise SiC particles and the carrier fluid comprises a lithium-based thickener dispersed in a base oil, and a paraffin oil.

16. The apparatus of claim 15, wherein:

the carbonyl iron particles have an average diameter of 10-30 micrometers, and the SiC particles have an average diameter of 10-30 micrometers.

* * * * *